US005967618A

United States Patent [19]

Wimmer et al.

[11] Patent Number: 5,967,618

[45] Date of Patent: Oct. 19, 1999

[54] IN-LINE ROLLER SKATE WHEEL

[75] Inventors: Gloria Faye Wimmer; Alfred Joseph Wimmer, both of Boulder, Colo.

[73] Assignee: Mer. Bon. Products, Incorporated, Boulder, Colo.

[21] Appl. No.: 08/844,317

[22] Filed: Apr. 18, 1997

Related U.S. Application Data

[ 60] Provisional application No. 60/015,562, Apr. 18, 1996.

[51] Int. Cl.[6] ..... A63C 17/22

[52] U.S. Cl. ..... 301/5.3; 152/323; 152/393

[58] Field of Search ..... 301/5.3, 5.7, 64.7; 152/323, 393, 394; 280/11.22, 11.23

[56] References Cited

U.S. PATENT DOCUMENTS 3,578,812 5/1971 Taussig et al. ..... 301/64.7

5,320,418 6/1994 Chen ..... 280/11.23 X 5,660,447 8/1997 Angelici ..... 301/5.7

*Primary Examiner*—Russell D. Stormer

*Attorney, Agent, or Firm*—Jennifer L. Bales; Macheledt Bales & Johnson LLP

[57] ABSTRACT

An in-line roller skate wheel is formed of a polyurethane tire injection molded onto a plastic hub, also formed by injection molding. The hub includes semicircular recesses along the outside rim to prevent the tire from slipping with respect to the hub. The hub also includes sloped surfaces on its outer rim to prevent the tire from slipping sideways with respect to the hub. The hub further includes annular ridges formed on the sloped surfaces, to prevent sideways slippage of the tire with respect to the hub, and also to allow the hub to be removed from the injection mold. The bearing seats of the hub have notches cut out to allow the hub to slide and lock onto the tire injection mold.

11 Claims, 9 Drawing Sheets

DETAIL B
SCALE 6/1

SECTION B-B

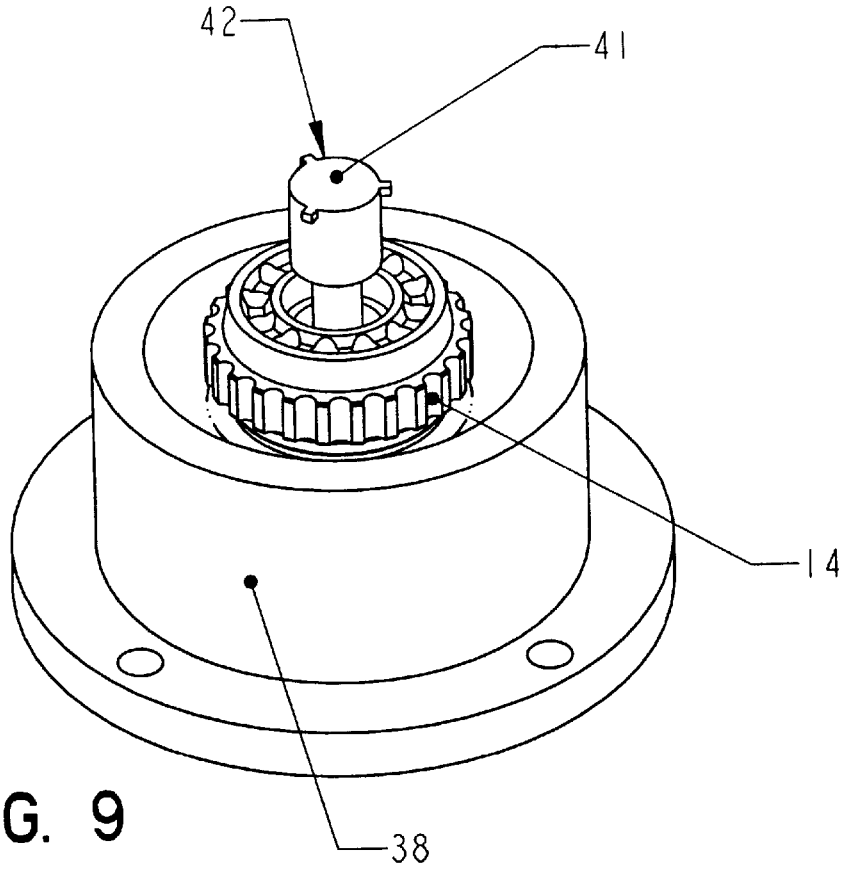
FIG. 9
FIG. 10
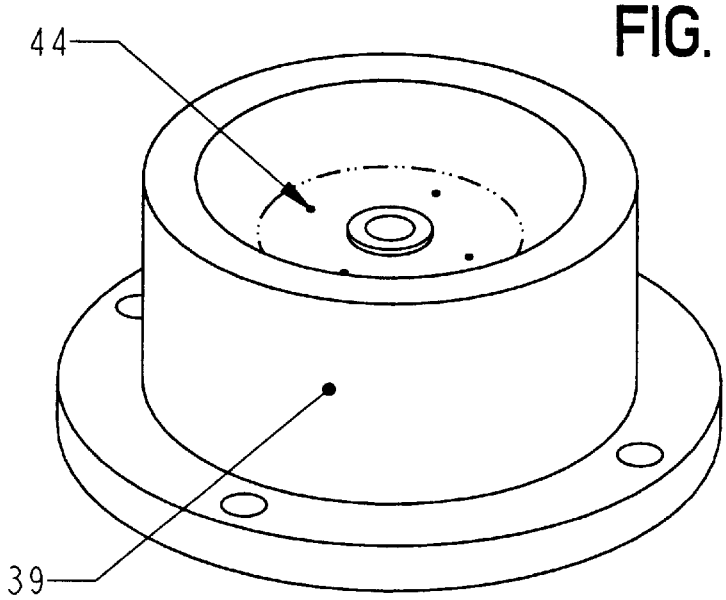

IN-LINE ROLLER SKATE WHEEL

This application claims the benefit of U.S. Provisional Application No. 60/015,562, filed on Apr. 18,1996.

BACKGROUND OF THE INVENTION

1. Field of the Invention

The present invention relates to in-line roller skate wheels and skateboard wheels.

2. Description of the Prior Art

Users of in-line roller skates are notoriously hard on the wheels. Between scraping the wheels on the ground in order to slow down, jumping off stairs, making frequent, sudden turns, and doing various trick skating moves, a skater can go through a set of skate wheels in a matter of weeks. Even more importantly, conventional skate wheels can be a safety hazard, as the outside polyurethane wheel can break loose and slide on the inner wheel hub.

A need remains in the art for an in-line roller skate wheel having a firm bond between the tire and the hub.

SUMMARY OF THE INVENTION

An object of the present invention is to provide an in-line roller skate wheel having a firm bond between the tire and the hub. The in-line roller skate wheel is formed of a polyurethane tire injection molded onto a plastic hub, also formed by injection molding. The hub includes semi-circular recesses along the outside rim to prevent the tire from slipping with respect to the hub. The hub also includes sloped surfaces on its outer rim to prevent the tire from slipping sideways with respect to the hub. The hub further includes ridges formed on the sloped surfaces, to prevent sideways slippage of the tire with respect to the hub, and also to allow the hub to be removed from the injection mold. The bearing seats of the hub have notches cut out to allow the hub to slide and lock onto the tire injection mold.

Specifically, the wheel comprises a circular hub having an outer perimeter and an axis, a bearing opening formed about the axis, and two faces perpendicular to the axis, the hub having recesses disposed about the perimeter, and a tire disposed about the perimeter of the hub, the tire having an inner surface and forming protrusions along the inner surface complementary to the recesses and disposed within the recesses. The protrusions disposed within the recesses prevent the tire from slipping on the hub. The recesses generally comprise semicircular grooves parallel to the hub axis.

The hub further forms a sloped surface extending away from the perimeter of the hub, toward the axis of the hub as it slopes outward toward one of the faces of the hub, and the tire forms a sloped surface along the inner surface of the tire, complementary to and adjacent to the sloped surface of the hub. The hub sloped surface adjacent to said tire sloped surface prevents the tire from slipping sideways on the hub.

In general, the hub forms two sloped surfaces extending away from the perimeter of the hub, toward the axis of the hub as they slope outward toward the faces and the tire forms two sloped surfaces along the inner surface of the tire, said tire sloped surfaces complementary to and adjacent to the hub sloped surfaces. The hub sloped surface further includes an irregular surface, e.g. annular ridges, for preventing the tire from slipping on the hub.

The hub and the wheel are formed by separate injection molding processes.

The hub's bearing opening forms a plurality of shoulders about the edge of the opening, which are spaced apart to form notches for permitting the hub to be inserted and locked onto an injection mold.

The method of forming the wheel includes the steps of injection molding the hub, inserting the hub on an injection mold and twisting the hub to lock it on the mold, and injection molding a tire onto the hub.

BRIEF DESCRIPTION OF THE DRAWINGS

FIG. 9 shows an isometric view of the hub of FIGS. 1–3 locked onto a mold base.

FIG. 10 shows an isometric view of a mold cover for the mold base of FIG. 9.

DETAILED DESCRIPTION OF THE PREFERRED EMBODIMENT

Figure 1:
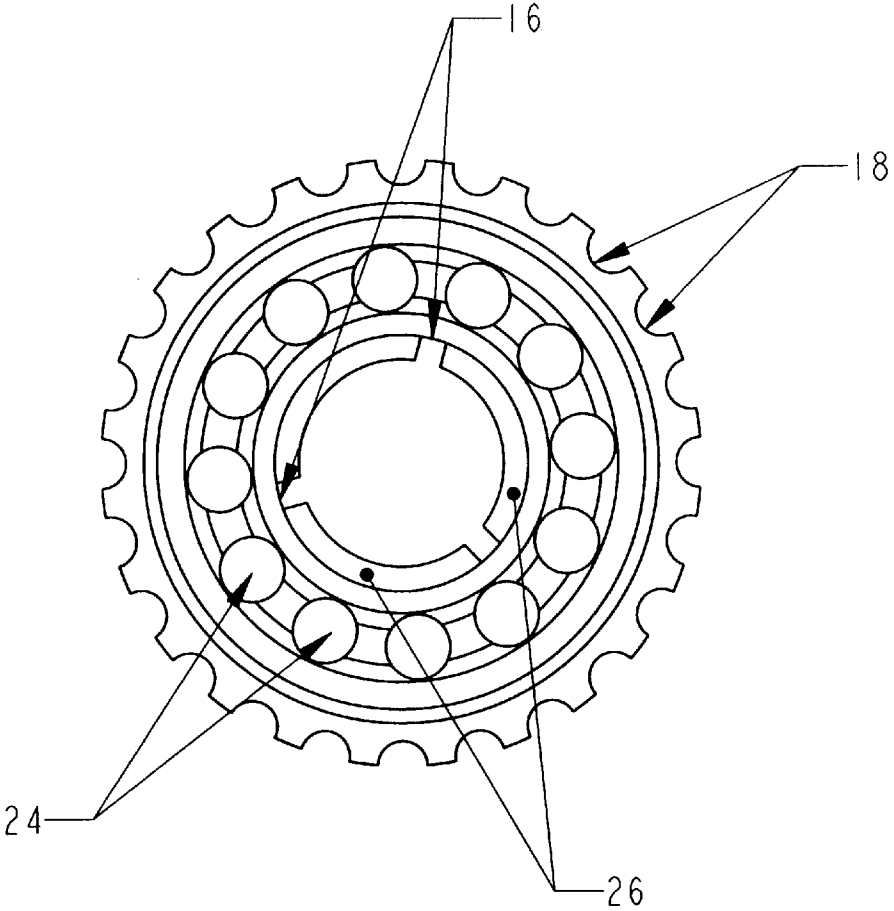
FIG. 1 shows a side view of the hub of a wheel in accordance with the present invention.
Figure 3:
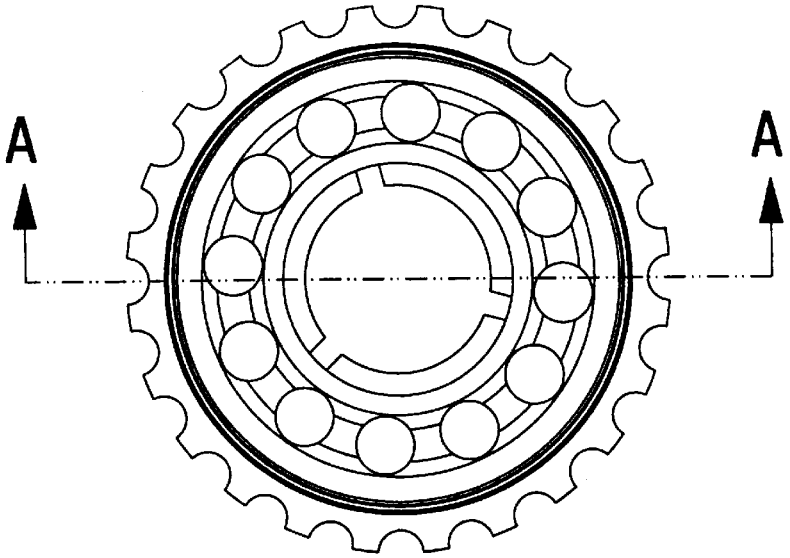
FIG. 3 shows a front section view of the hub of FIG. 1, along section lines A—A.
Figure 3:
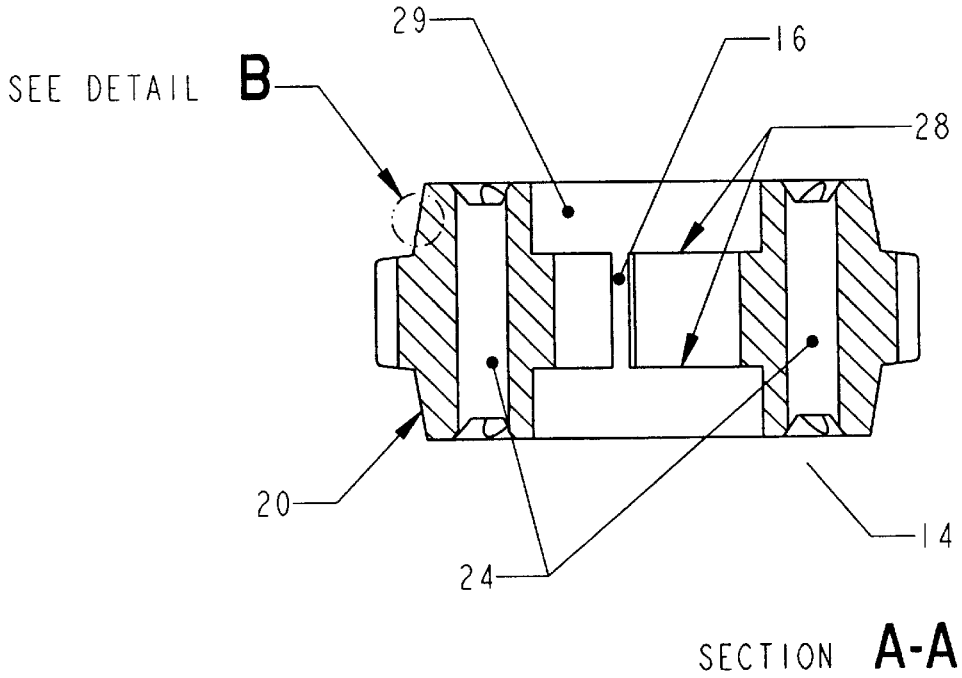
Figure 6:
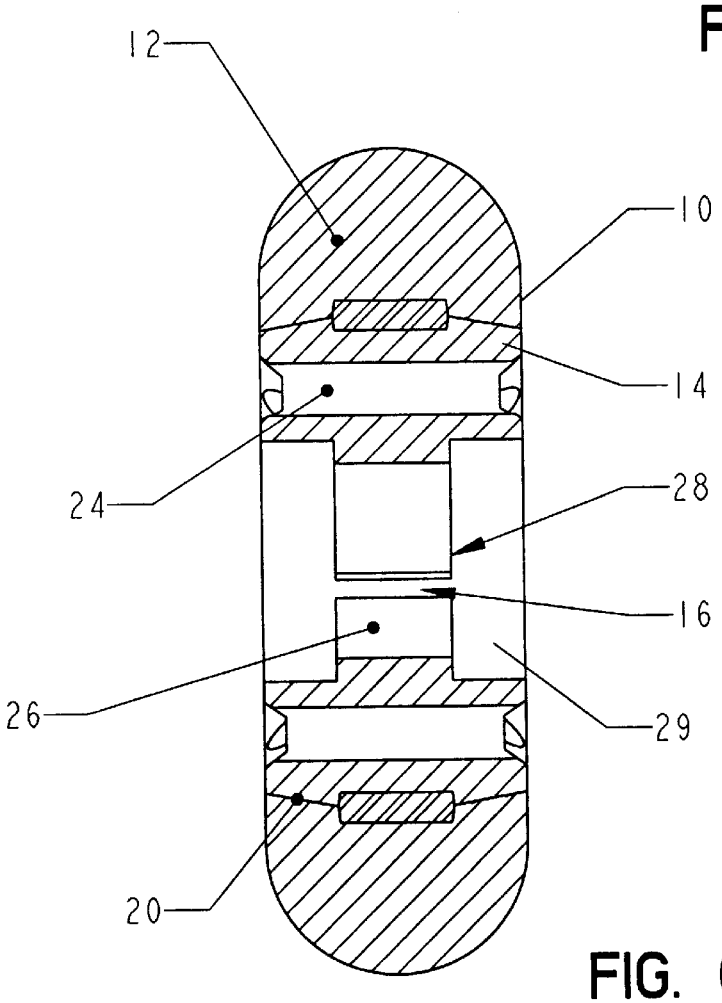
FIG. 6 shows a front section view of the wheel of FIG. 5, along section line B—B.
Figure 5:
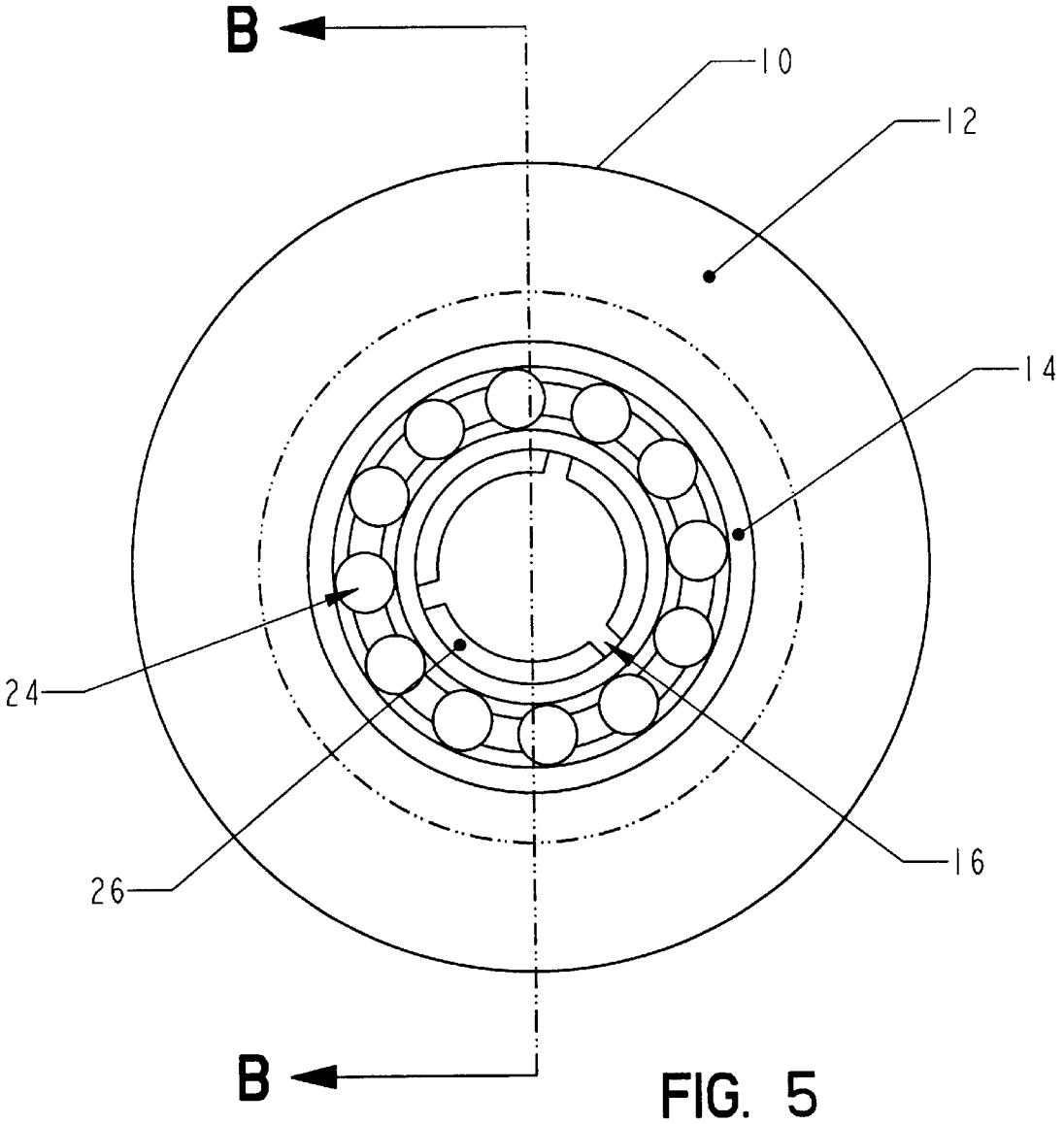
FIG. 5 shows a side view of a wheel in accordance with the present invention.

FIG. 1 shows a side view of hub (or rim) 14 of wheel 10 (shown in FIGS. 5 and 6). Notches 16 are cut out between shoulders 26. Notches 16 are used to permit hub 14 to be inserted and locked onto injection molding base 38, as shown in FIG. 9. Through holes 24 promote cooling of hub 14 during skate use, and also reduce weight. Semi-circular cut-outs (or recesses) 18 prevent tire 12 (shown in FIGS. 5 and 6) from slipping radially on hub 14. The section taken along lines A—A is shown in FIG. 3. In the preferred embodiment, hub 14 is formed of Esterlock plastic available from B.F. Goodrich Chemicals. Hub 14 is formed by a conventional injection molding process. The plastic comes in pellets, which are poured from a hopper into a barrel. The barrel is heated to melt the plastic. Then, the melted plastic is forced by a screw into a mold. The molded plastic is cooled and cured for several days.

Figure 2:
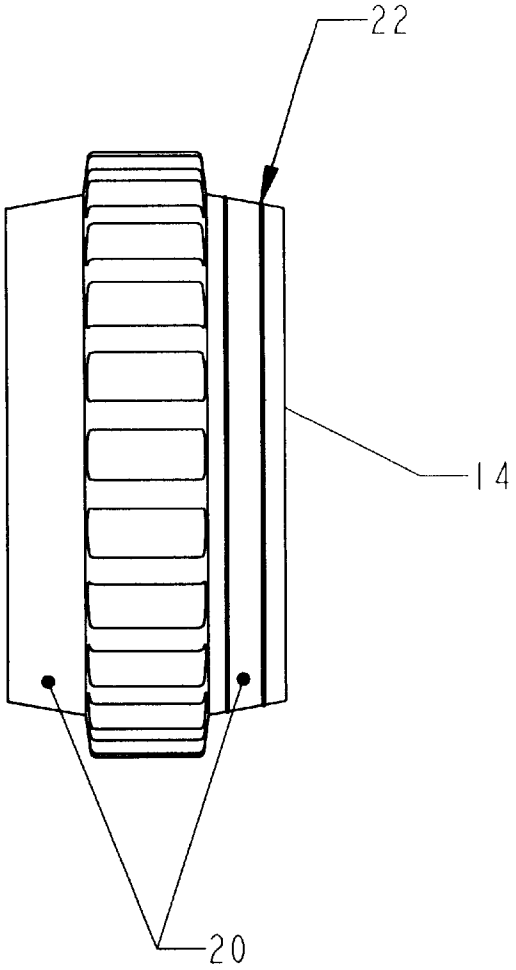
FIG. 2 shows a front view of the hub of FIG. 1.

FIG. 2 shows a front view of hub 14. Sloped surfaces 20 on hub 14 prevent tire 12 (shown in FIGS. 5 and 6) from slipping sideways on hub 14. Ridges 22 (shown best in FIG. 4) serve two purposes. They help prevent sideways slippage of tire 12 on hub 14. In addition, they permit hub 14 to be gripped and removed from its injection mold (not shown).

Figure 4:
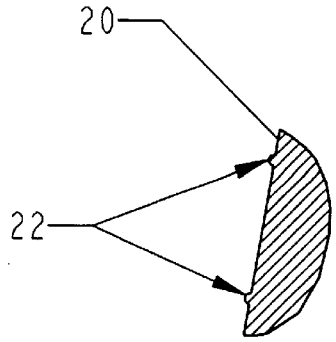
FIG. 4 shows a detailed view of a ridged sloped surface of the hub of FIGS. 1–3.

FIG. 3 shows a front section view of hub 14, along section lines A—A from FIG. 1. Detail B is shown in FIG. 4. The inner surface of bearing 14 is cut back to bearing seats 28 to form bearing cut-outs 29. Bearing cut-outs 29 are better shown in FIGS. 7 and 8. Through-holes 24 promote cooling of wheel 10, and lower the weight of hub 14. Notches 16 allow hub 14 to lock onto mold base 38 as shown in FIG. 9. FIG. 4 shows a detailed view (detail B of FIG. 3) of sloped surface 20 of hub 14. Ridges 22 prevent sideways slippage of tire 12 on hub 14, and also assist in the removal of hub 14 from the injection mold (not shown).

FIG. 5 shows a side view of wheel 10, comprising tire 12 on hub 14. The section view along section line B—B is shown in FIG. 6. Tire 12 is formed of a urethane plastic called Estane, and available from B.F. Goodrich Chemicals. Tire 12 is formed by a conventional injection molding process onto hub 14, which was itself formed by injection molding. This process is shown in FIGS. 9–13. The Estane adheres to the outer perimeter of hub 14 and is prevented from sliding radially by cutouts 18, and from sliding sideways by sloped surfaces 20 and ridges 22. FIG. 6 shows a front section view of wheel 10, along section line B—B of FIG. 5.

Figure 8:
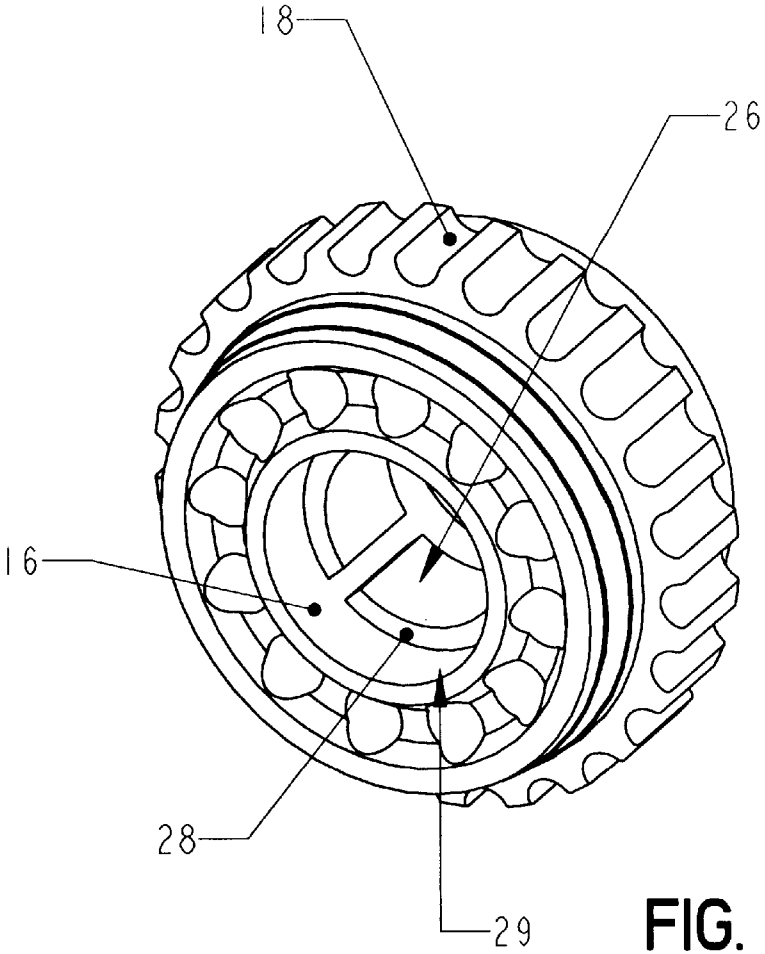
FIG. 8 shows a second isometric view of the hub of FIGS. 1–3.
Figure 7:
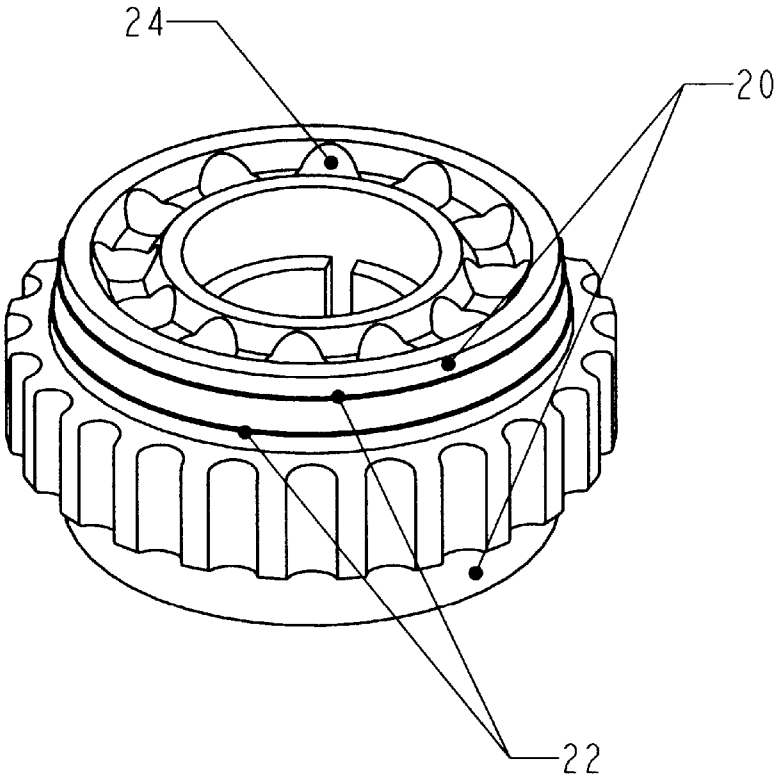
FIG. 7 shows an isometric view of the hub of FIGS. 1–3.

FIGS. 7 and 8 show two isometric views of hub 14. The structure of semi-circular cutouts 18, as well as sloped surfaces 20 and ridges 22 are evident from these figures. Bearing cutouts 29 allow the insertion of bearings (not shown) permitting wheel 10 to be used on an in-line skate. The bearings (not shown) rest on bearing seats 28 of shoulders 26. Notches 16 are cut out of shoulders 26 to allow hub 14 to be locked onto mold base 38 before tire 12 is injection molded onto hub 14.

Figure 11:
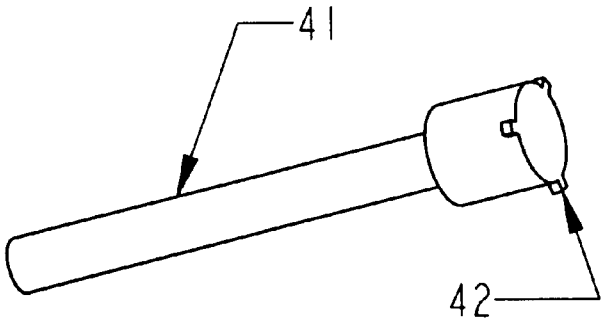
FIG. 11 shows an isometric view of the hub clamp of FIG. 9.
Figure 13:
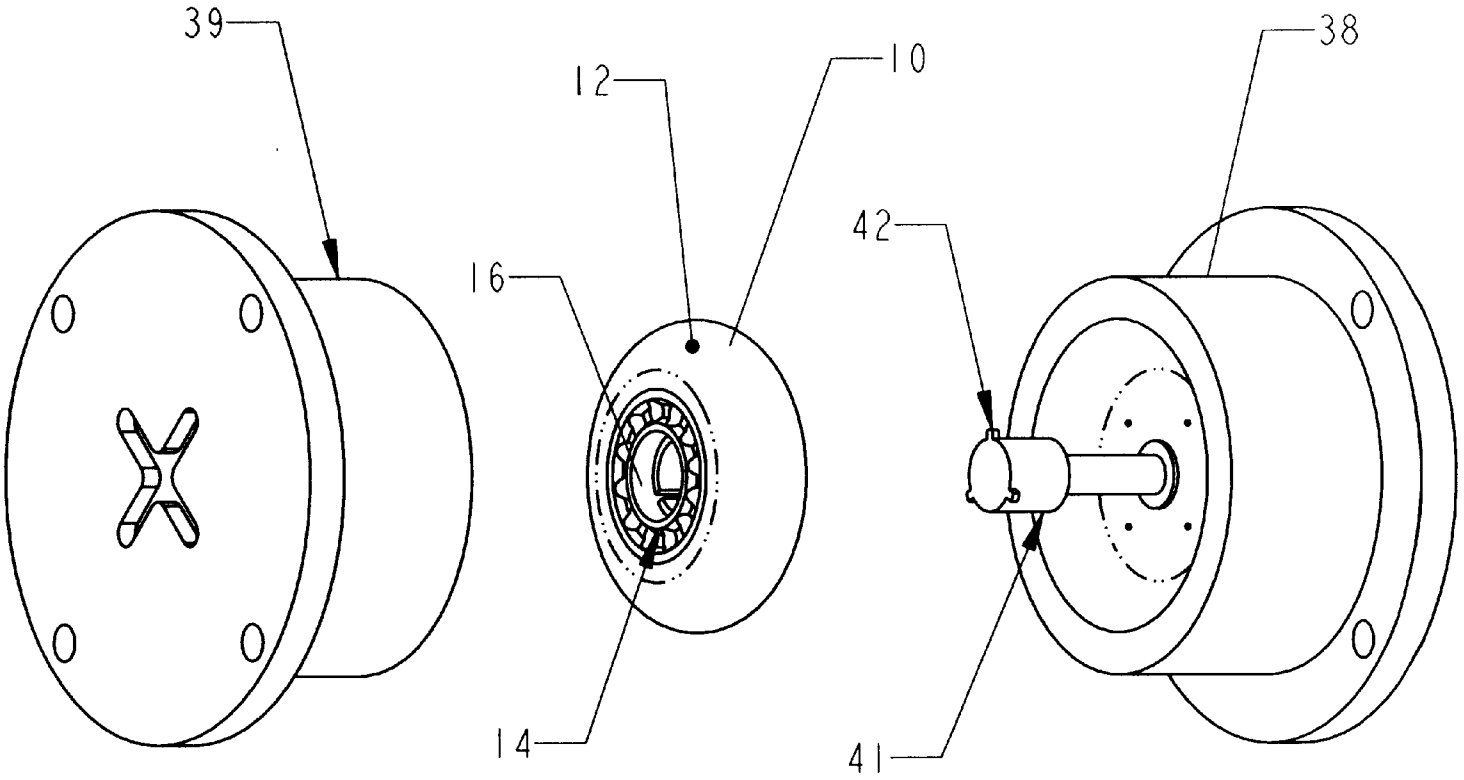
FIG. 13 shows an exploded view of the wheel of FIGS. 5 and 12 within the mold base and cover of FIGS. 9, 10 and 12.

FIG. 9 shows an isometric view of hub 14 locked onto mold base 38. Hub clamp 41, affixed to mold base 38 as shown in FIG. 13, has three hub clamping tabs 42 about its top perimeter. Hub 14 is oriented so that its three notches 16 are aligned with the three tabs 42 so that hub 14 slides onto hub clamp 41. Then hub 14 is twisted so that notches 16 are no longer aligned with tabs 42, and hub clamp mechanism 41 retracts into its "locked" position, locking hub 14 onto mold 38. FIG. 11 shows an isometric view of hub clamp 41.

FIG. 10 shows an isometric view of mold cover 39 for mold base 38. Mold cover 39 includes four injection ports 44, for injection of the urethane tire 12 onto hub 14. Mold cover 39 is placed on top of mold base 38 before the urethane, or Estane, for tire 12 is injected, as shown in FIG. 13.

Figure 12:
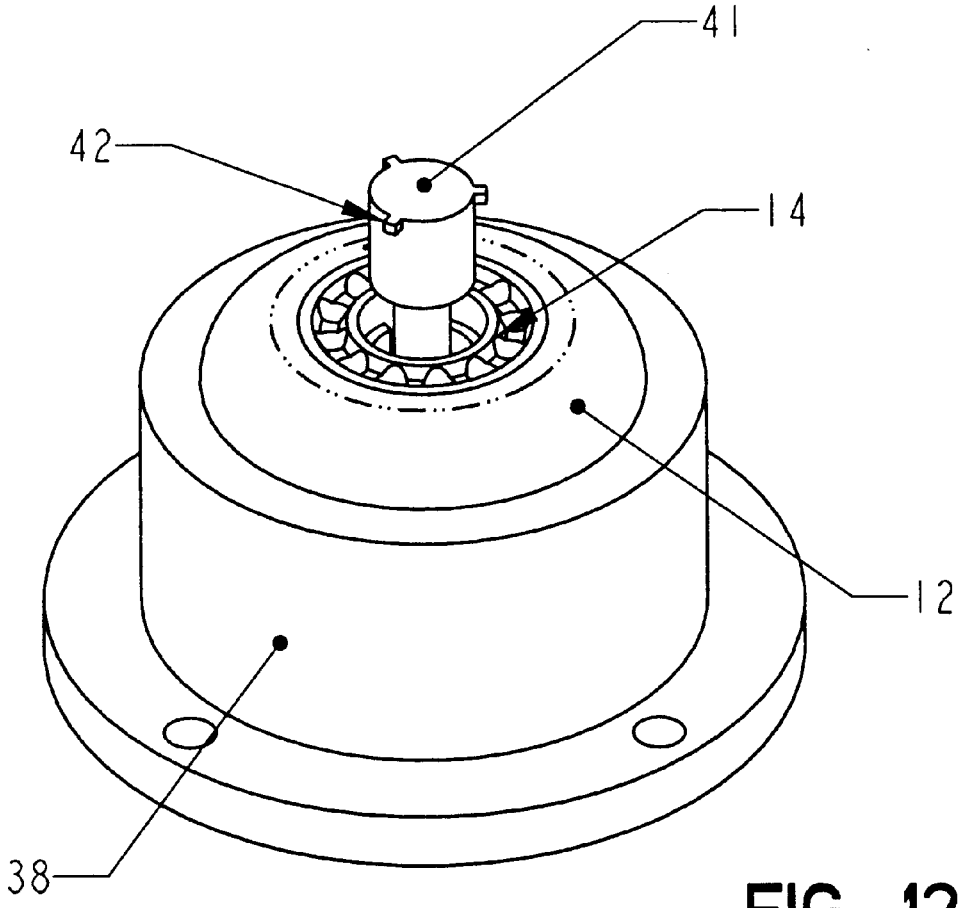
FIG. 12 shows an isometric view of the hub of FIGS. 1–3 locked onto the mold base after the wheel of FIG. 5 has been injection molded onto the hub.

FIG. 12 shows an isometric view of hub 14 on mold base 38 after tire 12 has been injection molded onto hub 14. Hub clamp 41 has moved outward to its "released" position (the amount of outward movement of hub clamp 41 has been exaggerated for clarity). Wheel 10 is allowed to set for a period to allow a hard skin to form on the outside of tire 12 before removal from mold 38. The wheel 10 is placed briefly in water to promote further cooling. Finally, wheel 10 is allowed to cure for several days before it is shipped. FIG. 13 shows an exploded view of wheel 10 within mold base 38 and cover 39.

Figure 14:
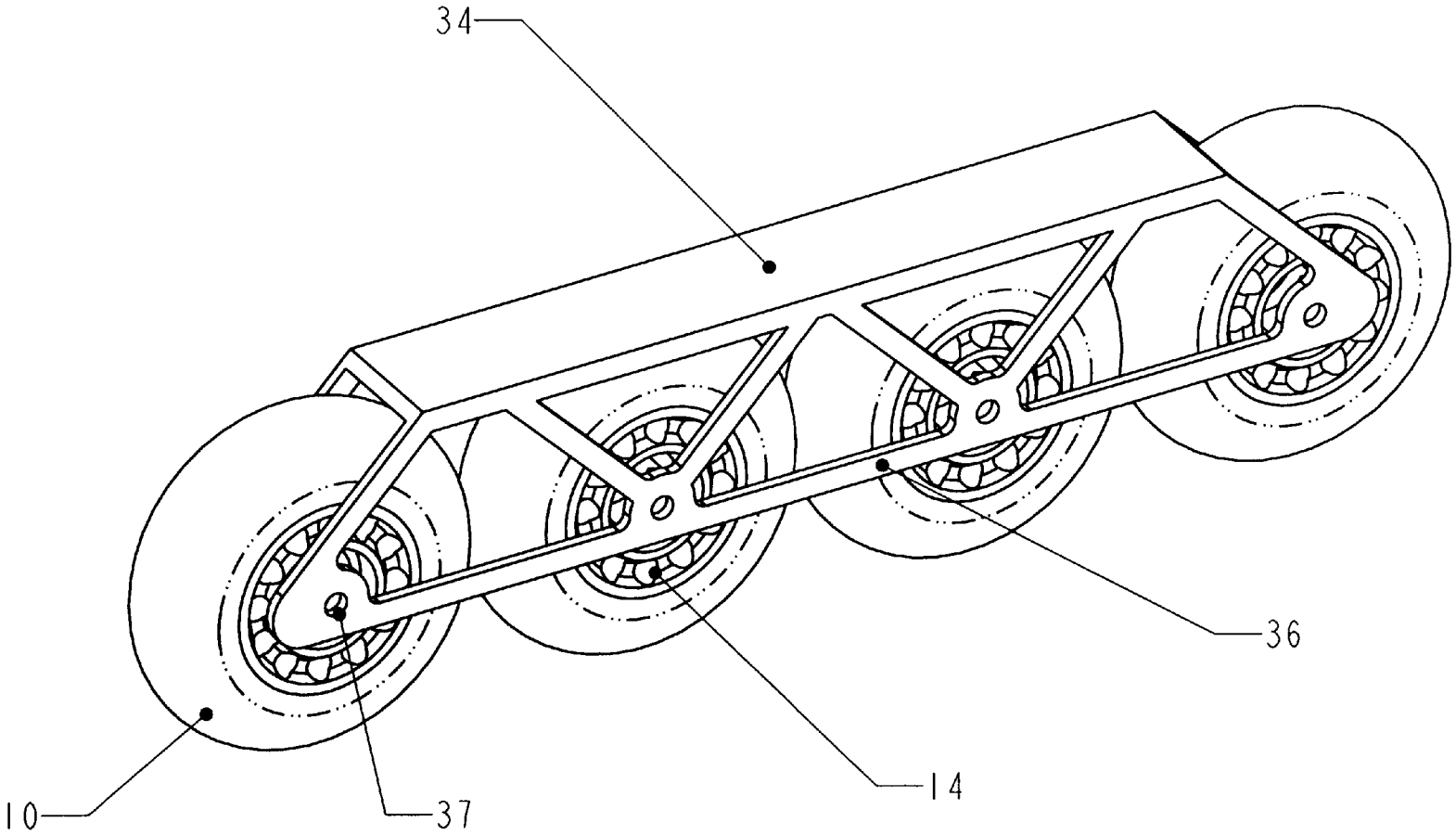
FIG. 14 shows an in-line skate base utilizing the wheels of FIG. 5.

FIG. 14 shows an in-line skate base 34 utilizing wheels 10. After bearings (not shown) have been inserted into bearing cutouts 29, the bearings are bolted onto wheel support structure 36 through holes 37. An in-line skate boot (not shown) is attached to the top of skate base 34.

While the exemplary preferred embodiment of the present invention is described herein with particularity, those skilled in the art will appreciate various changes, additions and applications other than those specifically mentioned, which are within the spirit and scope of this invention.

What is claimed is:

1. A wheel comprising:

a circular hub, said hub having an outer perimeter and an axis, a bearing opening formed about the axis, and two faces perpendicular to the axis, said hub having recesses disposed about said perimeter; and a tire disposed about the perimeter of the hub, said tire having an inner surface, said tire forming protrusions along the inner surface complementary to the recesses and disposed within the recesses;

wherein the protrusions disposed within the recesses prevent the tire from slipping on the hub;

the hub further forming a sloped surface extending away from the perimeter of the hub, said hub sloped surface extending toward the axis of the hub as it slopes outward toward one of the faces of the hub; and the tire forming a sloped surface along the inner surface of the tire, said tire sloped surface complementary to and adjacent to the sloped surface of the hub;

wherein said hub sloped surface adjacent to said tire sloped surface prevents the tire from slipping sideways on the hub.

2. The wheel of claim 1 wherein the recesses comprise semicircular grooves parallel to the hub axis.

3. The wheel of claim 1, wherein said hub sloped surface further comprises an irregular surface for preventing the tire from slipping on the hub.

4. The wheel of claim 3, wherein the hub sloped surface includes annular ridges.

5. The wheel of claim 3, wherein the hub and the wheel are formed by separate injection molding processes.

6. A circular hub for a wheel comprising:

an outer perimeter and an axis, a bearing opening formed about the axis, and two faces perpendicular to the axis, said hub having recesses disposed about said perimeter;

the hub further forming two sloped surfaces extending away from the perimeter of the hub, the sloped surfaces extending toward the axis of the hub as they slope outward toward the faces of the hub.

7. The hub of claim 6, wherein the bearing opening forms a plurality of shoulders about the edge of the opening, said shoulders spaced apart to form notches for permitting the hub to be inserted and locked onto an injection mold.

8. The hub of claim 6, wherein the sloped surfaces further comprise annular ridges.

9. The method of forming a wheel comprising the steps of:

molding a hub to include an outer perimeter and an axis, a bearing opening formed about the axis, two faces perpendicular to the axis, and two sloped surfaces extending away from the perimeter of the hub, the sloped surfaces extending toward the axis of the hub as they slope outward toward the faces of the hub, wherein the bearing opening forms a plurality of shoulders about the edge of the opening, said shoulders spaced apart to form notches for permitting the hub to be inserted and locked onto an injection mold;

inserting the hub on an injection mold and twisting the hub to lock it on the mold; and injection molding a tire onto the hub.

10. The method of claim 9, further including the step of forming annular ridges on the hub sloped surfaces.

11. The method of claim 9, wherein the step of molding the hub comprises injection molding.

* * * * *